US009105272B2

(12) United States Patent
Satt et al.

(10) Patent No.: US 9,105,272 B2
(45) Date of Patent: Aug. 11, 2015

(54) VOCAL SOURCE EXTRACTION BY MAXIMUM PHASE DETECTION

(75) Inventors: Aharon Satt, Kiriat Tivon (IL); Zvi Kons, Yokneam Ili (IL); Ron Hoory, Ramat Yishay (IL); Virgilijus Ulozas, Kaunas (LT)

(73) Assignees: The Lithuanian University of Health Sciences, Kaunas (LT); INTERNATIONAL BUSINESS MACHINES CORPORATION, Armonk, NY (US)

( * ) Notice: Subject to any disclaimer, the term of this patent is extended or adjusted under 35 U.S.C. 154(b) by 460 days.

(21) Appl. No.: 13/487,275

(22) Filed: Jun. 4, 2012

(65) Prior Publication Data

US 2013/0325455 A1 Dec. 5, 2013

(51) Int. Cl.

| | |
|---|---|
| ***G10L 25/75*** | (2013.01) |
| *G10L 25/03* | (2013.01) |
| *G10L 25/45* | (2013.01) |

(52) U.S. Cl.

CPC ..... *G10L 25/75* (2013.01); *G10L 25/03* (2013.01); *G10L 25/45* (2013.01)

(58) Field of Classification Search

CPC ..... G10L 29/90
USPC ..... 704/265, 200–230
See application file for complete search history.

(56) References Cited

PUBLICATIONS

Cheng, Yan Ming, and Douglas O'Shaughnessy. "Automatic and reliable estimation of glottal closure instant and period." Acoustics, Speech and Signal Processing, IEEE Transactions on 37.12 (1989): 1805-1815.*

Bozkurt et al., "Zeros of Z-Transform Representation With Application to Source-Filter Separation", IEEE Signal Processing Letters, vol. 12, No. 4, pp. 344-347, Apr. 2005.

Doval et al., "The voice source as a causal/anticausal linear filter", Proceedings of the Conference VOQUAL03 (Voice Quality: Functions, Analysis & Synthesis.), pp. 15-20, Geneva, Switzerland, Aug. 27-29, 2003.

Sturmel et al., "A comparative evaluation of the Zeros of Z-transform representation for voice source estimation", Interspeech07, pp. 558-561, Antwerp, Belgium, Aug. 27-31, 2007.

Bozkurt, B., "Zeros of the z-transform (ZZT) representation and chirp group delay processing for the analysis of source and filter characteristics of speech signals", Thesis Work submitted to Faculté Polytechnique de Mons for the degree of Doctor of Philosophy in Applied Sciences, Oct. 21, 2005.

Drugman et al., "Chirp Decomposition of Speech Signals for Glottal Source Estimation", Proceedings of NOLISP (ISCA Workshop on Non-Linear Speech Processing), Barcelona, Spain, Jun. 27-29, 2009.

Drugman et al., "Glottal Source Estimation Using an Automatic Chirp Decomposition", Advances in Nonlinear Speech Processing, Lecture Notes in Computer Science, vol. 5933, pp. 35-42, year 2010.

Uloza et al., "Categorizing Normal and Pathological Voices: Automated and Perceptual Categorization", Journal of Voice, vol. 25, issue 6, pp. 700-708, Nov. 2011.

Degottex, G., "Glottal Source and Vocal-Tract Separation", PhD Thesis, l'Universit'e Paris VI—Pierre et Marie Curie (UPMC), Nov. 16, 2010.

* cited by examiner

*Primary Examiner* — Abul Azad
(74) *Attorney, Agent, or Firm* — D. Kligler IP. Services Ltd.

(57) ABSTRACT

Methods, apparatus and computer program products implement embodiments of the present invention that include receiving a time domain voice signal, and extracting a single pitch cycle from the received signal. The extracted single pitch cycle is transformed to a frequency domain, and the misclassified roots of the frequency domain are identified and corrected. Using the corrected roots, an indication of a maximum phase of the frequency domain is generated.

19 Claims, 8 Drawing Sheets

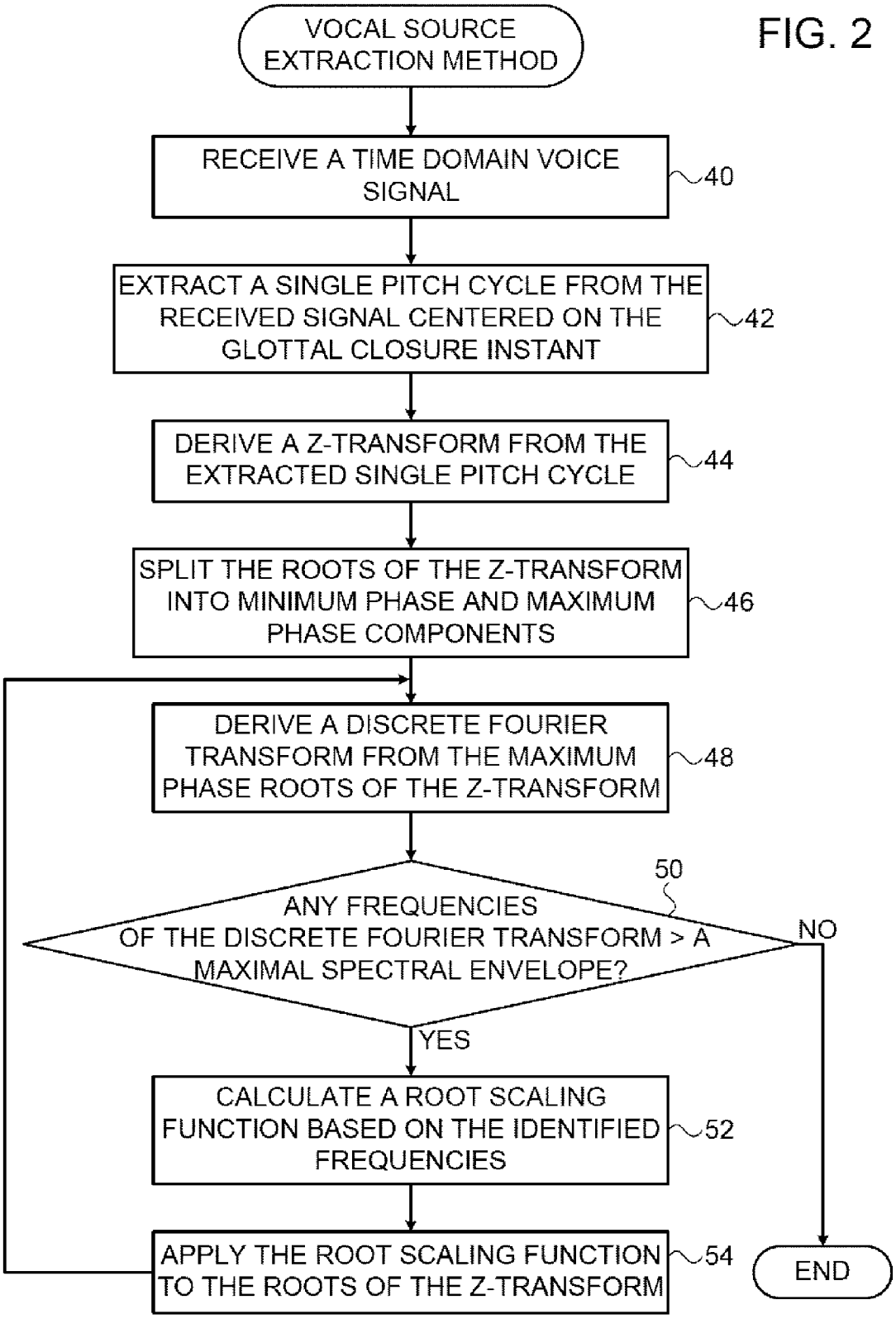
FIG. 2
VOCAL SOURCE EXTRACTION METHOD
RECEIVE A TIME DOMAIN VOICE SIGNAL
40
EXTRACT A SINGLE PITCH CYCLE FROM THE RECEIVED SIGNAL CENTERED ON THE GLOTTAL CLOSURE INSTANT
42
DERIVE A Z-TRANSFORM FROM THE EXTRACTED SINGLE PITCH CYCLE
44
SPLIT THE ROOTS OF THE Z-TRANSFORM INTO MINIMUM PHASE AND MAXIMUM PHASE COMPONENTS
46
DERIVE A DISCRETE FOURIER TRANSFORM FROM THE MAXIMUM PHASE ROOTS OF THE Z-TRANSFORM
48
50
ANY FREQUENCIES OF THE DISCRETE FOURIER TRANSFORM > A MAXIMAL SPECTRAL ENVELOPE?
NO
YES
CALCULATE A ROOT SCALING FUNCTION BASED ON THE IDENTIFIED FREQUENCIES
52
APPLY THE ROOT SCALING FUNCTION TO THE ROOTS OF THE Z-TRANSFORM
54
END

VOCAL SOURCE EXTRACTION BY MAXIMUM PHASE DETECTION

FIELD OF THE INVENTION

This invention relates generally to voice signal processing, and specifically to extracting a maximum phase component of a voice signal.

BACKGROUND OF THE INVENTION

Discrete Fourier transforms and Z-transforms are commonly used to analyze time domain signals and functions. A discrete Fourier transform transforms a function into a frequency domain representation of the original function, which is often a function in the time domain. Typically, a discrete Fourier transform requires an input function that is discrete and whose non-zero values have a limited (i.e., finite) duration. Inputs for discrete Fourier transforms are often created by sampling a continuous function (e.g., a person's voice). A Z-transform converts a discrete time-domain signal, which is a sequence of real or complex numbers, into a complex frequency-domain representation.

Time domain functions, discrete Fourier transforms and Z-transforms are related in the sense that one can be derived from any of the other. In other words, a discrete Fourier transform or a Z-transform can be derived from a time signal, a discrete Fourier transform or a time signal can be derived from a Z-transform, and a Z-transform or a time signal can be derived from a discrete Fourier transform.

SUMMARY OF THE INVENTION

There is provided, in accordance with an embodiment of the present invention a method, including receiving a time domain voice signal, extracting a single pitch cycle from the received signal, transforming the extracted single pitch cycle to a frequency domain, identifying and correcting misclassified roots of the frequency domain, and generating, using the corrected roots, an indication of a maximum phase of the frequency domain.

There is also provided, in accordance with an embodiment of the present invention an apparatus, including a memory, and a processor coupled to the memory and configured to receive a time domain voice signal, to extract a single pitch cycle from the received signal, to transform the extracted single pitch cycle to a frequency domain, to identify and correct misclassified roots of the frequency domain, and to generate, using the corrected roots, an indication of a maximum phase of the frequency domain.

There is further provided, in accordance with an embodiment of the present invention a computer program product, the computer program product including a non-transitory computer readable storage medium having computer readable program code embodied therewith, the computer readable program code including computer readable program code configured to receive a time domain voice signal, computer readable program code configured to extract a single pitch cycle from the received signal, computer readable program code configured to transform the extracted single pitch cycle to a frequency domain, computer readable program code configured to identify and correcting misclassified roots of the frequency domain, and computer readable program code configured to generate, using the corrected roots, an indication of a maximum phase of the frequency domain.

BRIEF DESCRIPTION OF THE DRAWINGS

The disclosure is herein described, by way of example only, with reference to the accompanying drawings, wherein:

FIG. 2 is a flow diagram that schematically illustrates a method of vocal source extraction, in accordance with an embodiment of the present invention;

DETAILED DESCRIPTION OF EMBODIMENTS

Overview

In human speech, pronunciation of vowels typically comprises two steps. Initially, air flows through vocal chords causing the vocal chords to vibrate, and then the vibration is modulated in spaces such as the mouth, nasal cavity etc. Air flowing through the glottis (i.e., the vocal chords and the space between the folds) is called a "glottal flow", and comprises a "maximum phase" (also referred to herein as a "vocal source") where the glottis opens, and a "minimum phase" where the glottis closes. A single cycle, comprising an opening-phase and a closing-phase of the glottis is called a "pitch cycle" or a "glottal pulse", and the point in time where the glottis closes is called a glottal closure instant (GCI).

Embodiments of the present invention provide methods and systems for extracting a maximum-phase component of a voice signal, as a representation of the opening-phase part of the vocal source. In some embodiments a single pitch cycle is first extracted from a time domain voice signal, and the extracted pitch cycle is then transformed to a frequency domain function. Misclassified roots (i.e., roots that are associated with a minimum phase of the extracted pitch cycle, but should be associated with the maximum phase of the pitch cycle, and vice versa) of the frequency domain function are identified, and a root scaling function is used to correct (i.e., reclassify) the misclassified roots. In some embodiments, an indication of the maximum phase (e.g., a time domain signal) can be derived from reclassified roots.

By accurately extracting the maximum phase of a voice signal, embodiments of the present invention can be used to develop automatic diagnosis-assistive solutions that can aid in detection and screening of early-stage voice pathology for a general population or for populations at risk. For example, early stage laryngeal diseases can be detected by analyzing the maximum phase of sustained vowel phonations.

System Description

Figure 1:
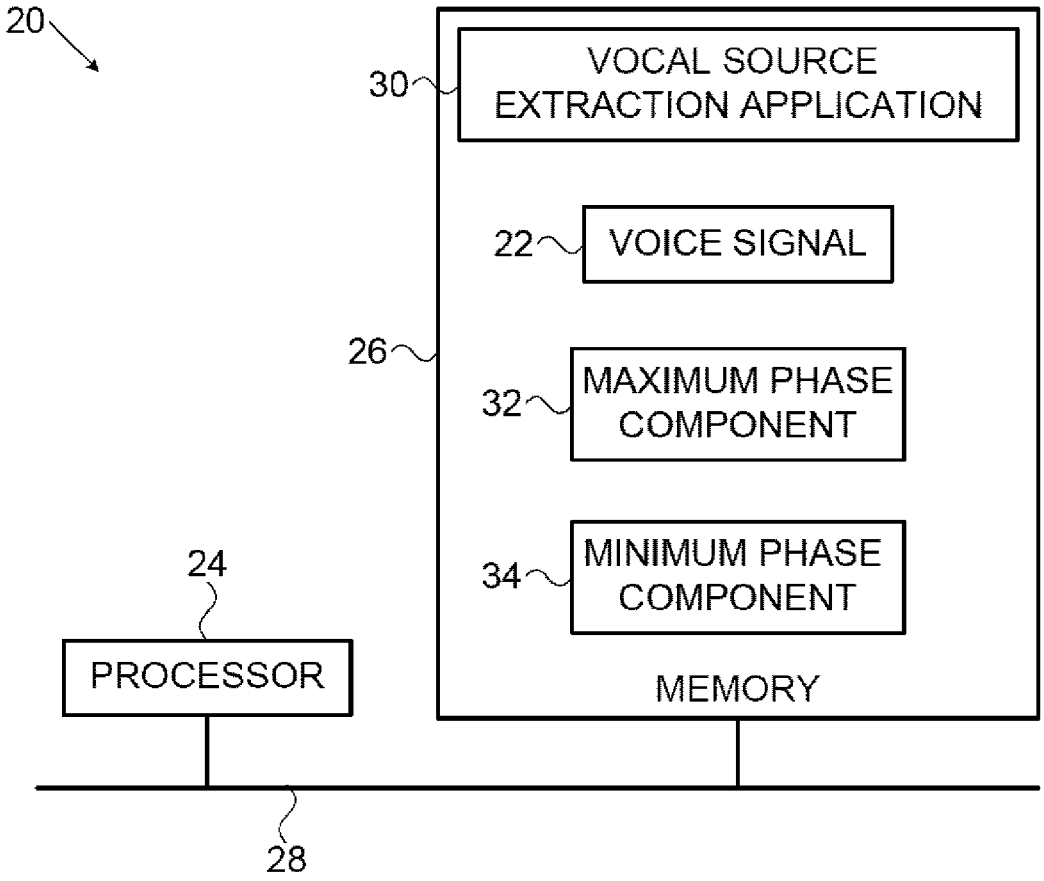
FIG. 1 is a schematic pictorial illustration of a system configured to segment a voice signal into its maximum phase and minimum phase components.

FIG. 1 is a schematic pictorial illustration of a system 20 configured to segment a voice signal 22 into its maximum and minimum phase components, in accordance with an embodiment of the present invention. System 20 comprises a processor 24 coupled to a memory 26 via a bus 28. In operation, processor 24 executes vocal source extraction application 30 that is configured to segment voice signal 22 into a maximum phase component 32 and a minimum phase component 34.

Processor 24 typically comprises a general-purpose computer configured to carry out the functions described herein. Software operated by the processor may be downloaded to the memories in electronic form, over a network, for example, or it may be provided on non-transitory tangible media, such as optical, magnetic or electronic memory media. Alternatively, some or all of the functions of the processor may be carried out by dedicated or programmable digital hardware components, or by using a combination of hardware and software elements.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system". Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described herein with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Maximum and Minimum Phase Segmentation

Figure 3:
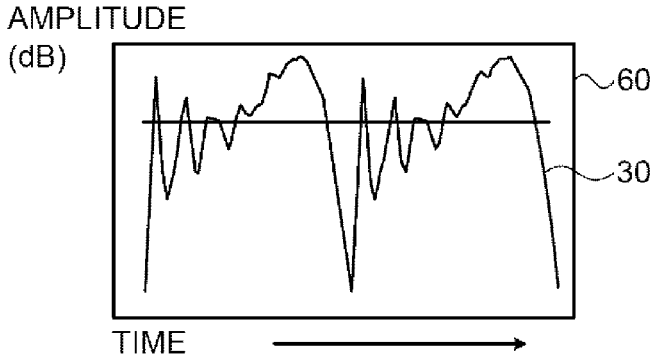
FIG. 3 is a graph showing amplitudes of a time domain voice signal, in accordance with an embodiment of the present invention.
Figure 4:
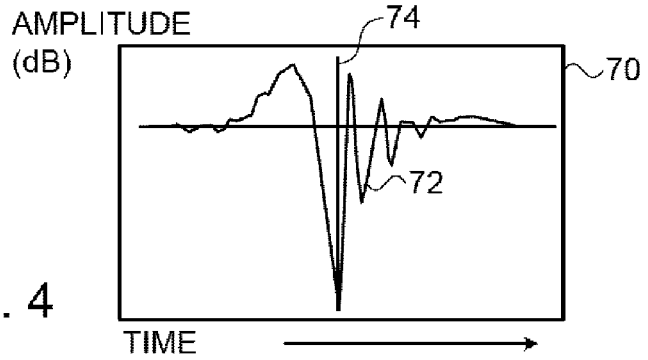
FIG. 4 is a graph showing amplitudes of a single pitch cycle extracted from the time domain voice signal, in accordance with an embodiment of the present invention.
Figure 5A:
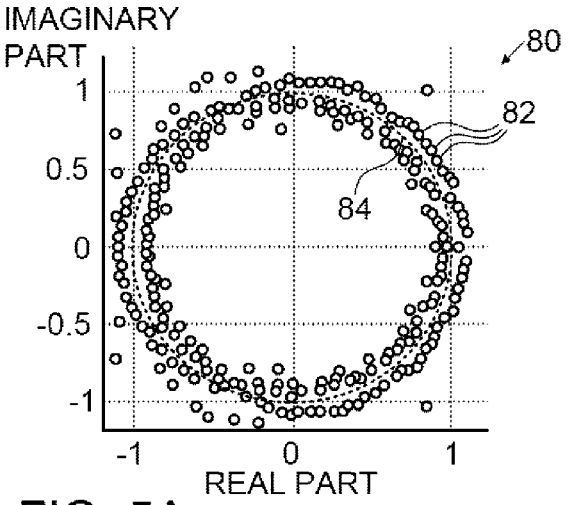
FIG. 5A is a graph showing roots of a Z-transform that was derived from the single pitch cycle, in accordance with an embodiment of the present invention.
Figure 5B:
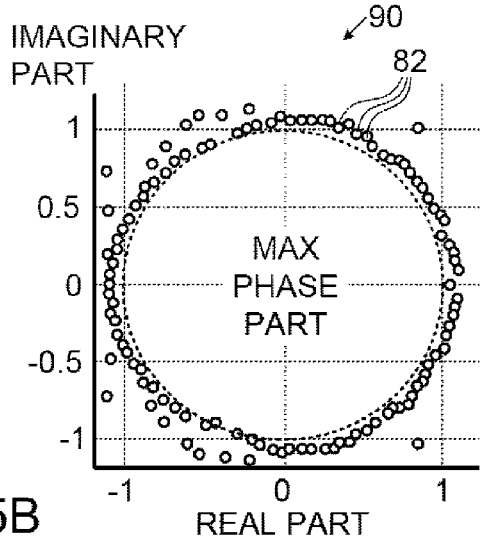
FIG. 5B is a graph showing the roots of the Z-transform associated with a maximum phase spectrum (i.e. of the single pitch cycle), in accordance with an embodiment of the present invention.

FIG. 2 is a flow diagram that schematically illustrates a method of vocal source extraction, in accordance with an embodiment of the present invention. FIG. 3 is a graph 60 showing amplitudes of time domain voice signal 30, and FIG. 4 is a graph 70 showing amplitudes of a single pitch cycle 72 extracted from the voice signal, in accordance with an embodiment of the present invention. FIG. 5A is a graph 80 showing roots 82 of a Z-transform that was derived from single pitch cycle 72, and FIG. 5B is a graph 90 showing the roots of a maximum phase spectrum (i.e. of the single pitch cycle), in accordance with an embodiment of the present invention.

Figure 6:
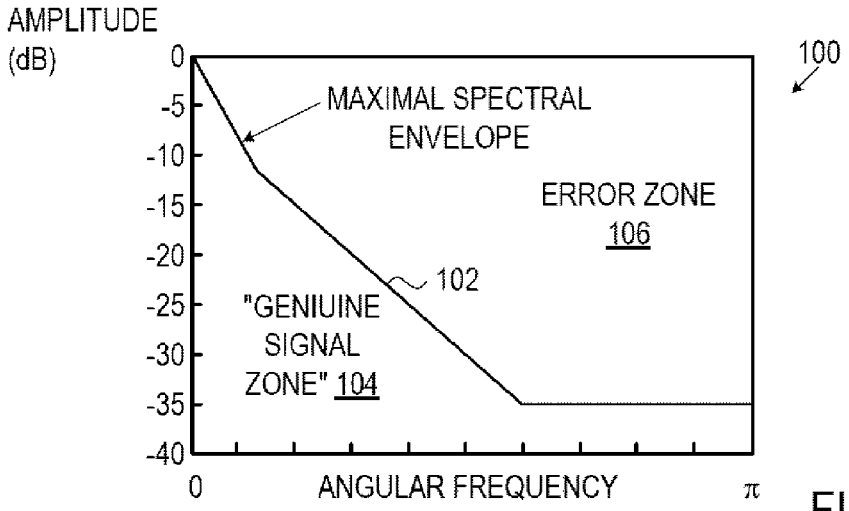
FIG. 6 is a graph showing amplitudes of a maximum spectral envelope, in accordance with an embodiment of the present invention.
Figure 7:
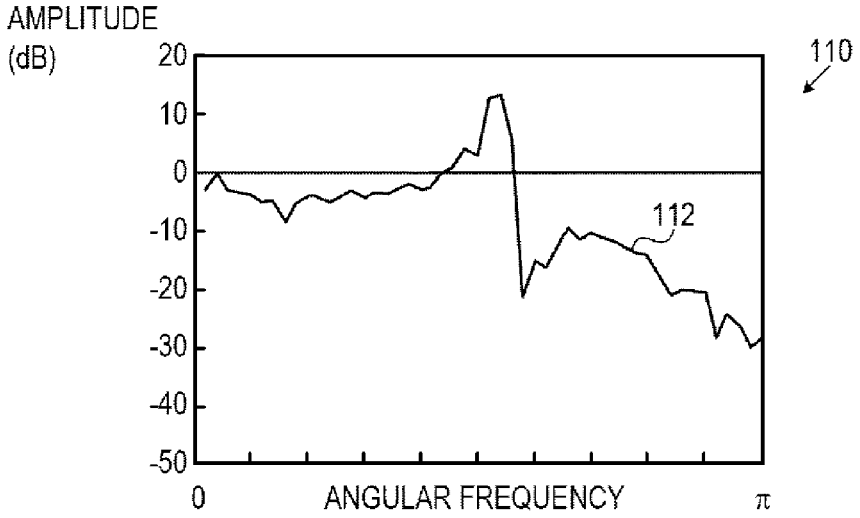
FIG. 7 is a graph showing a difference between the maximum-phase spectrum and the maximal spectral envelope, in accordance with an embodiment of the present invention.
Figure 8:
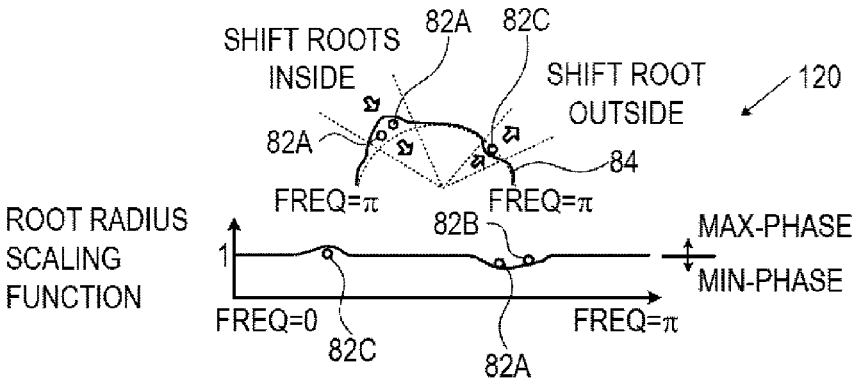
FIG. 8 is a pictorial illustration of applying a root scaling function to the roots of the Z-transform, in accordance with an embodiment of the present invention.

FIG. 6 is a graph 100 showing amplitudes of a maximum spectral envelope 102, and FIG. 7 is a graph 110 showing a difference 112 between the maximum-phase spectrum and the maximal spectral envelope, in accordance with an embodiment of the present invention. FIG. 8 is a pictorial illustration 120 of applying a root scaling function to roots 82, in accordance with an embodiment of the present invention.

In an initial step 40 in the flow diagram, processor 24 receives voice signal 30. In the configuration shown in FIG. 1, processor 24 retrieves voice signal 30 from memory 26. In alternative embodiments, processor 24 can either retrieve voice signal 30 from a storage device such as a disk drive (not shown), or receive the voice signal from an audio input device such as a microphone (not shown). Graph 60 in FIG. 3 is an amplitude vs. time graph showing two pitch cycles of voice signal 30. The X-axis (i.e., time) shown in FIG. 3 is normalized in order to include exactly two pitch cycles.

In an extraction step 42, processor 24 applies a window function (also commonly referred to as an apodization function or a tapering function) that is configured to extract single pitch cycle 72 centered on a GCI 74 in voice signal 30. Graph 70 in FIG. 4 shows the amplitude vs. time for extracted pitch cycle 72 centered on GCI 74. The X-axis (i.e., time) shown in FIG. 4 is also normalized in order to include exactly two pitch cycles.

Using techniques known in the art, in an extraction step 44, processor 24 derives a Z-transform from extracted pitch cycle 72. Graph 80 in FIG. 5A plots imaginary parts vs. real parts of roots 82 of the derived Z-transform. The graph also plots a unit circle 84. In a split step 46, processor 24 splits (i.e., classifies) roots 82 into roots associated with the maximum phase of pitch cycle 72, and roots associated with a minimum phase of the pitch cycle. Typically, roots 82 that are positioned inside unit circle 84 comprise roots associated with the minimum phase, and roots that are positioned outside unit circle 84 comprise roots associated with the maximum phase. Graph 90 in FIG. 5B shows roots 82 that are associated with the maximum phase of the pitch cycle.

In a second derivation step 48, processor 24 calculates a maximum-phase spectrum, which comprises a discrete Fourier transform derived from the maximum phase roots of the Z-transform. In a comparison step 50, the processor checks if any frequencies in the maximum phase spectrum have amplitudes greater than a reference signal such as maximum spectral envelope 102. As shown in FIG. 6, any amplitudes (less than and) equal to maximal spectral envelope 102 are in a genuine signal zone 104, and any amplitudes greater than the maximal spectral envelope are in an error zone 106.

Graph 100 in FIG. 6 shows amplitudes of maximal spectral envelope 102, where the maximal spectral envelope comprises a reference spectrum for a vocal source that can be derived using algorithms such as the Liljencrants-Fant (LF) model for a vocal source, and then tuned and validated by numerous measurements of normal and pathological voice samples.

Amplitudes of the maximum-phase spectrum typically have values below the maximal phase spectrum. In other words, any amplitudes in the maximum-phase spectrum that is greater than a corresponding change in amplitude in the maximum-phase spectral envelope likely due to a given root 82 (i.e., associated with the amplitude greater than the maximal phase spectrum) that was incorrectly classified as being associated with the maximum phase.

Returning to comparison step 50, processor 24 checks if there are any angular frequencies in the maximum-phase spectrum whose amplitude is greater than a amplitude of a corresponding angular frequency in maximum spectral envelope 102. Graph 110 in FIG. 7 shows difference 112, which comprises subtracting maximal spectral envelope 102 from the maximum-phase spectrum. Therefore, difference 112 is greater than zero when an amplitude of a given angular frequency of the maximum-phase spectrum is greater than an angular frequency of a corresponding angular frequency of maximal spectral envelope 102. Likewise, difference 112 is less than zero when an amplitude of a given angular frequency of the maximum-phase spectrum is less than an angular frequency of a corresponding angular frequency of maximal spectral envelope 102

If, as shown in graph 112 (i.e., near angular frequency n/2), there are any differences greater than zero, then processor 24 calculates a root scaling function in a calculation step 52 to correct the roots 82, as explained in detail hereinbelow. The processor then applies the root scaling function to roots 82 (i.e., the roots of both the minimum and the maximum phases) in an application step 54, and the method continues with step 48.

In some embodiments, the root scaling function can be derived for example from difference 112 shown in FIG. 7. For example, processor 24 can scale the roots in the complex Z-plane, so that the maximum amplitude of difference 112 is less than or equal to zero (dB). In the example shown in FIG. 7, processor 24 creates a new curve by first truncating difference 112 from below, thereby setting all negative values (i.e., where the maximum phase spectrum is less than the maximal spectrum envelope) to zero. Processor 24 then adds 1.0 to the zero values (i.e., the values that were originally negative), resulting in difference 112A comprising a positive function (i.e., >=1.0) for all angular frequencies multiplied by a scalar factor, resulting in the root scaling function shown in FIG. 8 in the shifting of the roots shown in FIG. 8.

In some embodiments, processor 24 can iteratively search for the scalar function until a "correct" function is found (in other words, when the maximum phase roots of the spectrum are below zero). Assuming that E comprises a small value that processor 24 uses to changes the amplitude of the root scaling function, then processor 24 can iteratively search for the scaling function using the following sequence:

1−E, 1+E, 1−2*E, 1+2*E, 1−3*E, 1+3E . . . .

For example, if E=0.01, then the iteration comprises:

0.99, 1.01, 0.98, 1.02, 0.97, 1.03 . . . 0.90, 1.10

The iteration stops upon first "correct" result, or when a limit for E is reached (0.1 in the example shown hereinabove). The inventors have found that a typical value for E is approximately 0.001*M, where M comprises a maximum value of the positive function before applying the scaling function.

Graph 110 shows a specific case where a single pair of conjugate roots drifted slightly, possibly due to numerical errors in calculating the roots of the Z-transform, just enough to falsely cross the unit circle. A simple "fix" (i.e., via the root scaling function) restores the correct maximum-phase component. In general, multiple pairs of roots may need to be manipulated.

In operation, upon applying the proper root scaling function with the proper scalar factor (i.e., following the iterative search described supra), the scaling function shifts relevant roots across the Z-plane, so that the spectrum of the maximum phase signal is corrected. This correction (i.e., via the root scaling function described hereinabove) is due to the spectrum comprising a function of the location of the roots of the Z-transform.

FIG. 8 shows a first example of applying the root scaling function in step 54, where the root scaling function shifts roots 82A and 82B inside unit circle 84, and shifts root 82C outside the unit circle. After processor 24 applies the root scaling function, the processor "re-splits" the roots (i.e., into the minimum and the maximum phases, using unit circle 84).

Returning to step 50, the method ends when there are any no angular frequencies in the maximum-phase spectrum (i.e., the initial maximum phase spectrum, or the maximum phase spectrum after applying the root scaling function) whose amplitude is greater than an amplitude of a corresponding angular frequency in maximum spectral envelope 102. In other words, all frequencies have been shifted to the genuine signal zone.

Figure 9:
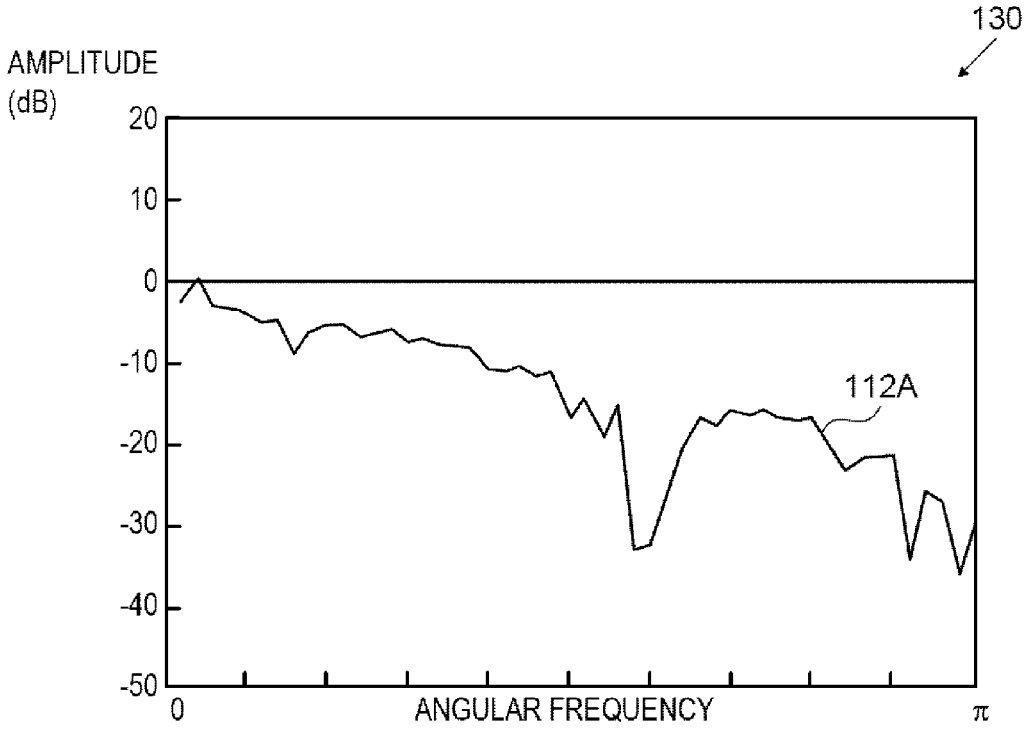
FIG. 9 is a graph showing a difference between the maximum-phase spectrum and the maximal spectral envelope after applying the root scaling function, in accordance with an embodiment of the present invention.

Graph 130 in FIG. 9 shows difference 112A, which comprises subtracting the maximum-phase spectrum of the corrected roots (i.e., after applying the root scaling function) from maximal spectral envelope 102. As shown in graph 130, applying the root scaling function to graph 112 was successful, since all the amplitudes of the maximum-phase spectrum are less than the corresponding amplitudes of maximal spectral envelope 102. However, in instances where difference 112A still contains positive values, the scaling process (i.e., steps 48-54 of the flow diagram) can be repeated until convergence.

As described supra, an indication of the maximum phase (e.g., a time domain signal) can be derived using the reclassified roots (i.e., the roots for the corrected maximum-phase spectrum that is referenced in graph 130 (i.e., FIG. 9). The derived time domain signal can be used in applications such as vocal training (for singers) or medical diagnoses. The figures described below show the time domain shape of maximum phase signals truncated to 100 samples, following time and amplitude normalization.

In the graphs shown in FIGS. 10A-C and FIGS. 11A-D that are discussed hereinbelow, the pitch cycles are normalized, so that the X-axis (i.e., time) comprises 100 points. Additionally, the amplitude (i.e., the Y-Axis) is normalized in order to present the amplitude in a consistent range.

Figure 10A:
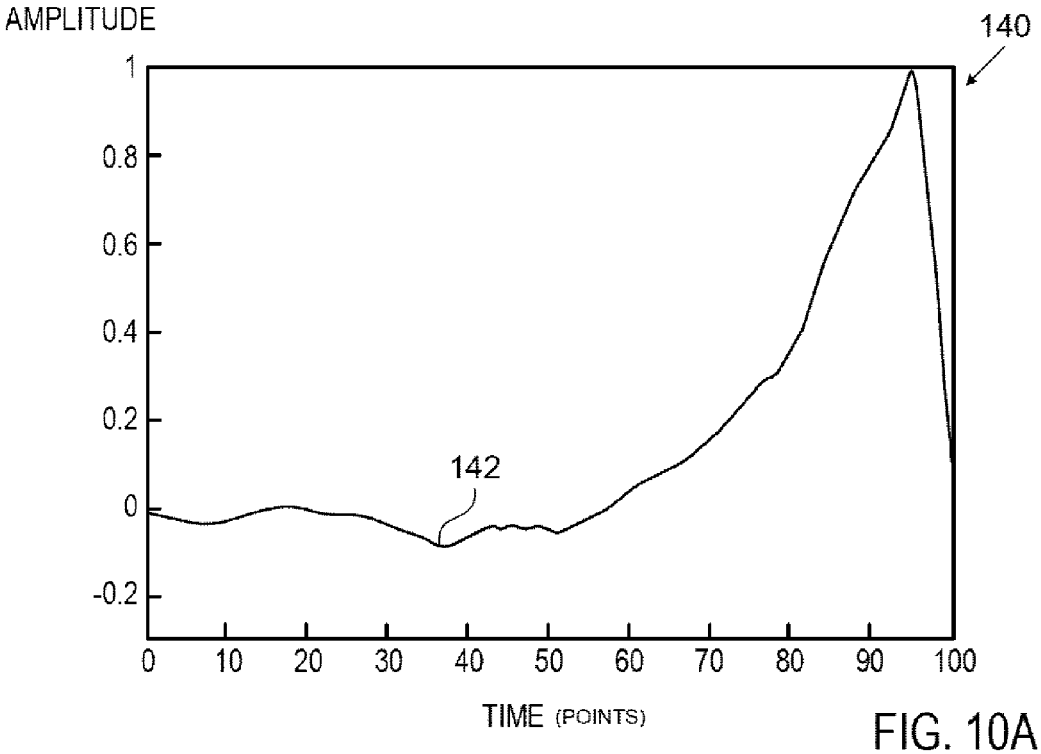
FIG. 10A is a graph showing a maximum-phase time domain signal extracted from the voice of a typical male, in accordance with an embodiment of the present invention.
Figure 10B:
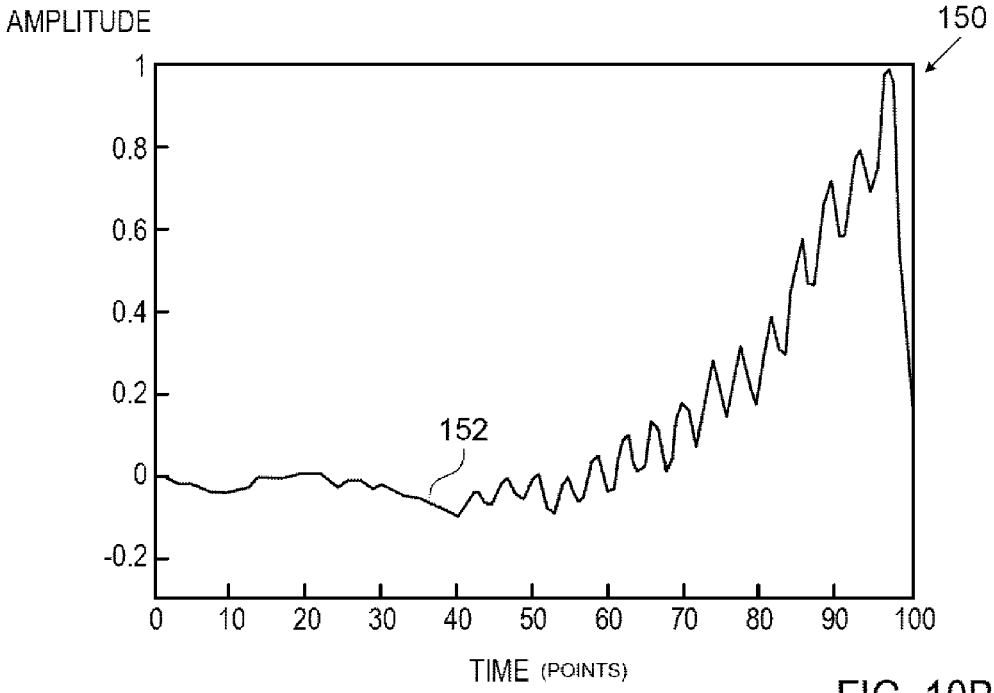
FIG. 10B is a graph showing a maximum-phase signal that includes misclassified roots of the Z-transform, in accordance with an embodiment of the present invention.

FIG. 10A is a graph 140 showing a maximum-phase time domain signal 142 extracted from the voice of a typical male, in accordance with an embodiment of the present invention. FIG. 10B is a graph 150 showing a maximum-phase signal 152 that includes misclassified maximum phase roots 82 of the Z-transform, in accordance with an embodiment of the present invention. The misclassified roots 82 comprise roots that are erroneously associated with the maximum phase (i.e., roots 82 that are outside unit circle 84 that should be positioned within the unit circle).

Figure 10C:
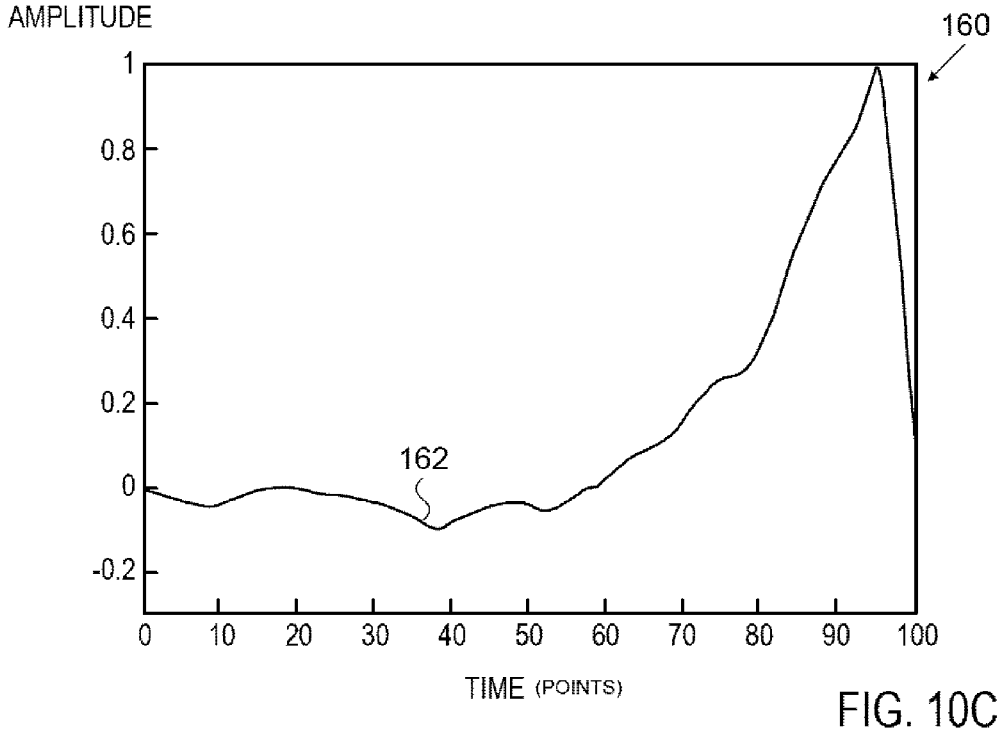
FIG. 10C is a graph showing a maximum-phase signal with corrected misclassified roots of the Z-transform, in accordance with an embodiment of the present invention.

FIG. 10C is a graph 160 showing a maximum-phase signal 162 with corrected (i.e., of previously misclassified) roots of maximum-phase signal 152, in accordance with an embodiment of the present invention. As shown in the figures, signal 152 shows distortion in the higher angular frequency parts of the signal, whereas signals 142 and 162 have relatively similar shapes.

Figure 11A:
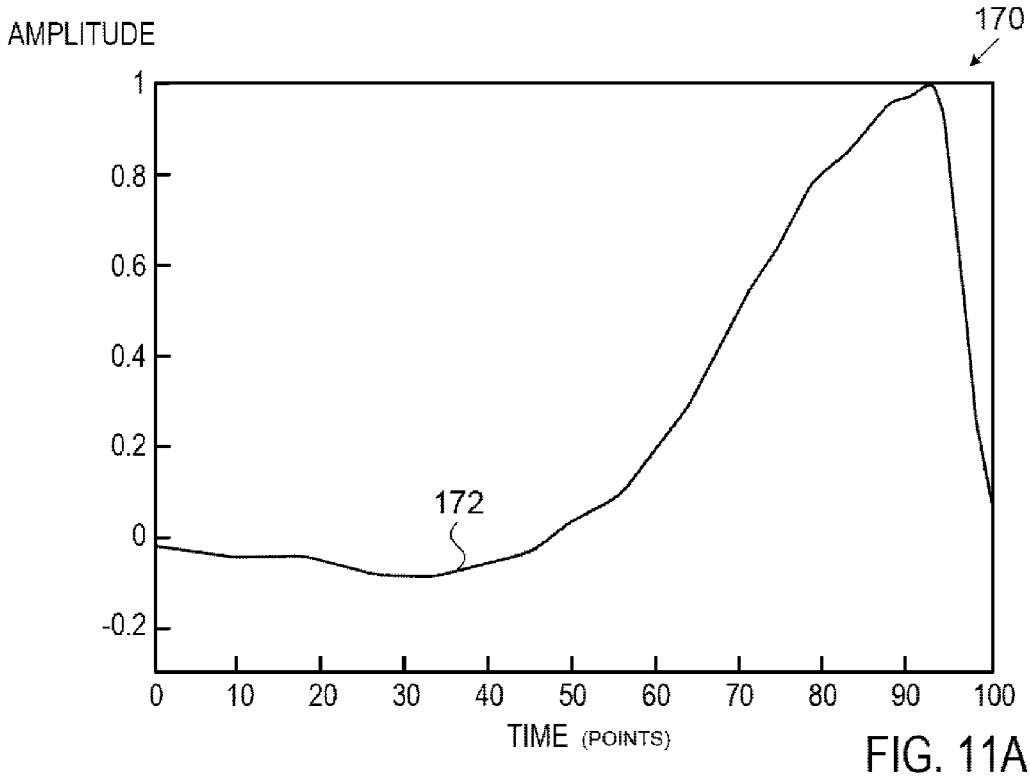
FIG. 11A is a graph showing a first example of a maximum phase signal for a typical female, in accordance with an embodiment of the present invention.
Figure 11B:
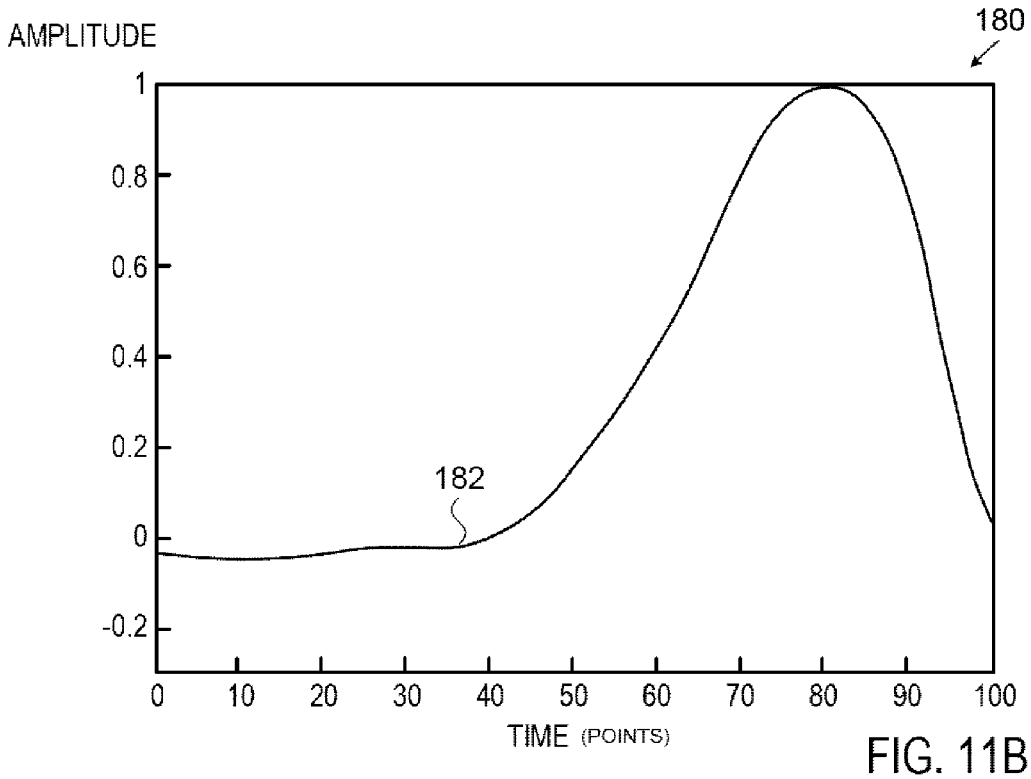
FIG. 11B is a graph showing a second example of a maximum phase signal for a mildly laryngeal-pathological female, in accordance with an embodiment of the present invention.
Figure 11C:
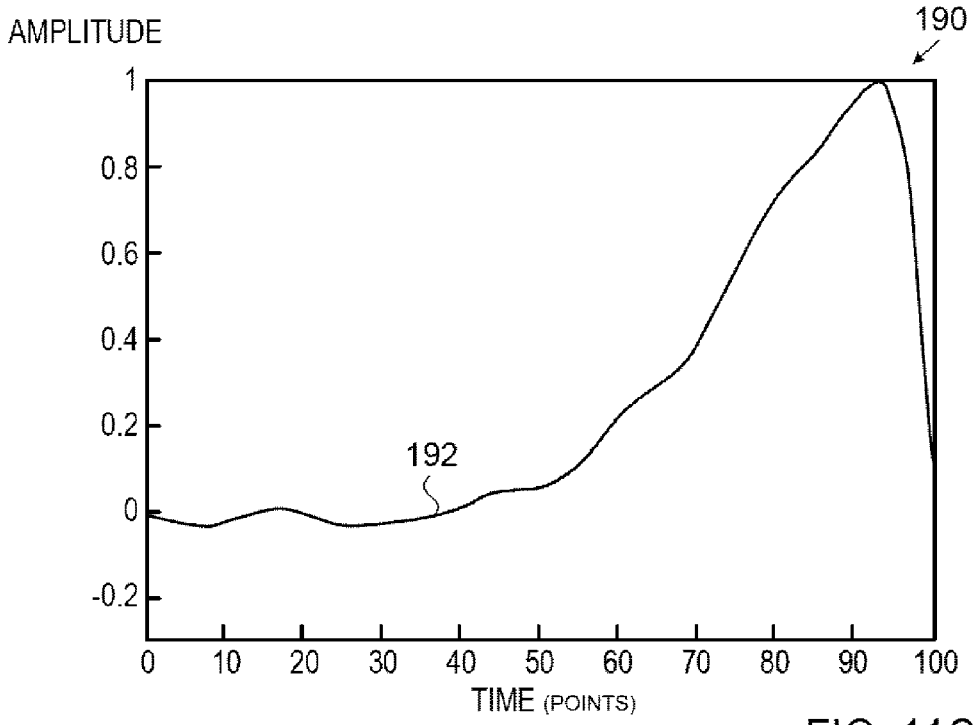
FIG. 11C is a graph showing a third example of a maximum phase signal for a typical male, in accordance with an embodiment of the present invention.
Figure 11D:
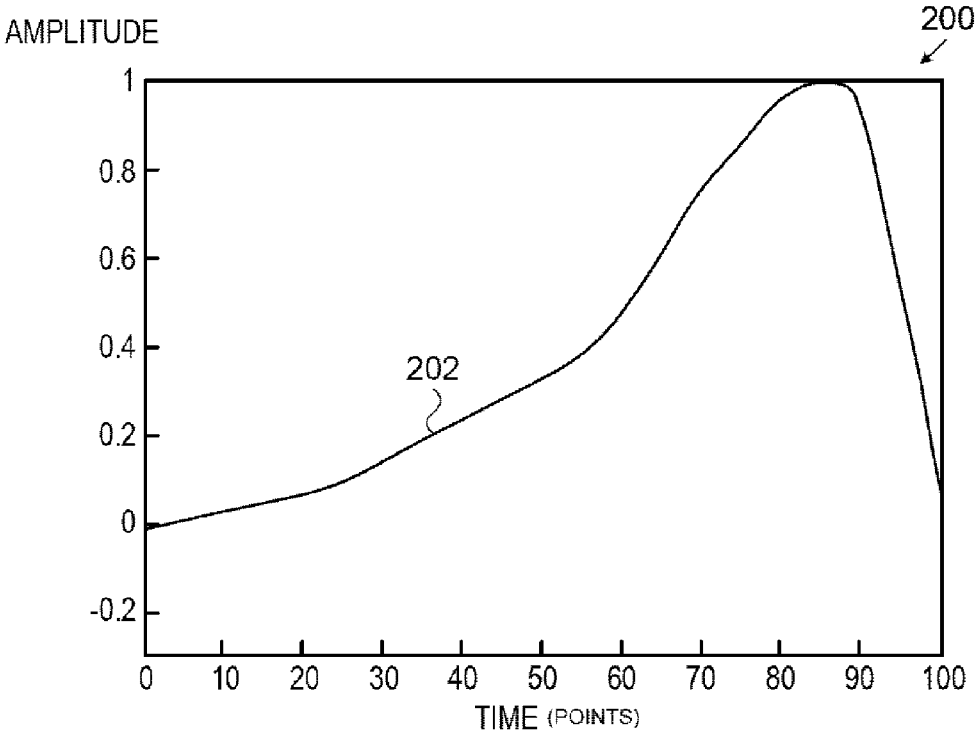
FIG. 11D is a graph showing a fourth example of a maximum phase signal for a mildly laryngeal-pathological male, in accordance with an embodiment of the present invention.

FIG. 11A is a graph 170 showing a first sample maximum phase signal 172 for a typical female, in accordance with an embodiment of the present invention. FIG. 11B is a graph 180 showing a second sample maximum phase signal 182 for a mildly laryngeal-pathological female, in accordance with an embodiment of the present invention. FIG. 11C is a graph 190 showing a third sample maximum phase signal 192 for a typical male, in accordance with an embodiment of the present invention. FIG. 11D is a graph 200 showing a fourth sample maximum phase signal 202 for a mildly laryngeal-pathological male, in accordance with an embodiment of the present invention.

As shown in signals 172, 182, 192 and 202, the typical signals tend to be asymmetric with an abrupt descent, whereas the pathological signals tend to be more symmetric with a gradual descent. Therefore, as discussed supra, embodiments of the present invention can be used to develop automatic diagnosis-assistive solutions that can aid in detection and screening of early-stage voice pathology.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It will be appreciated that the embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

The invention claimed is:

1. A method, comprising:

receiving, by a processor, a time domain voice signal;

extracting a single pitch cycle from the received signal;

transforming the extracted single pitch cycle to a first frequency domain having roots, by the processor;

extracting a sub-group of the roots of the first frequency domain, considered to correspond to a maximum phase component;

transforming the extracted sub-group of the roots into a second frequency domain;

correcting the roots of the first frequency domain responsive to the second frequency domain;

generating, using the corrected roots, an indication of a maximum phase of the frequency domain; and analyzing the indication of the maximum phase to provide information on the voice signal.

2. The method according to claim 1, wherein the extracted single pitch cycle is centered on a glottal closure instant.

3. The method according to claim 1, wherein extracting the single pitch cycle comprises applying a window function to the time domain voice signal.

4. The method according to claim 1, wherein transforming the single pitch cycle to the first frequency domain comprises deriving a Z-transform from the single pitch cycle.

5. The method according to claim 4, wherein correcting the roots of the first frequency domain comprises identifying angular frequencies of a spectrum of the second frequency domain, whose amplitude is greater than an amplitude of a corresponding angular frequency of a maximal spectral envelope, and scaling the roots in response to the identified angular frequencies.

6. The method according to claim 5, wherein extracting the sub-group of the roots comprises extracting roots positioned outside a unit circle.

7. The method according to claim 1, wherein transforming the extracted sub-group of the roots into a second frequency domain comprises applying a discrete Fourier transform to the extracted sub-group of the roots.

8. The method according to claim 1, wherein analyzing the indication of the maximum phase comprises detecting a maximal phase indicative of a laryngeal disease.

9. The method according to claim 1, comprising repeating the extracting of a sub-group of the roots, transforming the extracted sub-group of the roots and correcting the roots, until convergence.

10. An apparatus, comprising:

a memory;

a processor coupled to the memory, and configured to receive a time domain voice signal, to extract a single pitch cycle from the received signal, to transform the extracted single pitch cycle to a first frequency domain having roots, to extract a sub-group of the roots of the first frequency domain, considered to correspond to a maximum phase component, to transform the extracted sub-group of the roots into a second frequency domain, to correct the roots of the first frequency domain responsive to the second frequency domain, to generate, using the corrected roots, an indication of a maximum phase of the frequency domain, and to analyze the indication of the maximum phase to provide information on the voice signal.

11. The apparatus according to claim 10, wherein the extracted single pitch cycle is centered on a glottal closure instant.

12. The apparatus according to claim 10, wherein the processor is configured to extract the single pitch cycle by applying a window function to the time domain voice signal.

13. The apparatus according to claim 10, wherein the processor is configured to transform the single pitch cycle to the first frequency domain by deriving a Z-transform from the single pitch cycle.

14. The apparatus according to claim 13, wherein the processor is configured to identify angular frequencies of a spectrum of the second frequency domain, whose amplitude is greater than an amplitude of a corresponding angular frequency of a maximal spectral envelope, and scale the roots in response to the identified angular frequencies.

15. The apparatus according to claim 14, wherein the processor is configured to extract the sub-group of the roots by extracting roots positioned outside a unit circle.

16. The apparatus according to claim 10, wherein the second frequency domain comprises a discrete Fourier transform domain.

17. The apparatus according to claim 10, wherein the processor is configured to analyze the indication of the maximum phase to detect a maximal phase indicative of a laryngeal disease.

18. The apparatus according to claim 10, wherein the processor is configured to repeat the extracting of a sub-group of the roots, transforming the extracted sub-group of the roots and correcting the roots, until convergence.

19. A computer program product, the computer program product comprising:

a non-transitory computer readable storage medium having computer readable program code embodied therewith, the computer readable program code comprising:

computer readable program code configured to receive a time domain voice signal;

computer readable program code configured to extract a single pitch cycle from the received signal;

computer readable program code configured to transform the extracted single pitch cycle to a first frequency domain having roots;

computer readable program code configured to extract a sub-group of the roots of the first frequency domain, considered to correspond to a maximum phase component, to transform the extracted sub-group of the roots into a second frequency domain, and to correct the roots of the first frequency domain responsive to the second frequency domain; and computer readable program code configured to generate, using the corrected roots, an indication of a maximum phase of the frequency domain, and to analyze the indication of the maximum phase to provide information on the voice signal.

* * * * *